US007728459B2

(12) United States Patent
Lou et al.

(10) Patent No.: US 7,728,459 B2
(45) Date of Patent: Jun. 1, 2010

(54) POWER SUPPLY FOR REAL-TIME CLOCK GENERATION

(75) Inventors: Chih-Hong Lou, Yilan County (TW); Chih-Yuan Hsu, Tai-Nan Hsien (TW)

(73) Assignee: Mediatek Inc., Hsin-Chu (TW)

( * ) Notice: Subject to any disclaimer, the term of this patent is extended or adjusted under 35 U.S.C. 154(b) by 501 days.

(21) Appl. No.: 11/736,713

(22) Filed: Apr. 18, 2007

(65) Prior Publication Data

US 2007/0278861 A1 Dec. 6, 2007

Related U.S. Application Data

(60) Provisional application No. 60/746,175, filed on May 2, 2006.

(51) Int. Cl.
*H02J 1/00* (2006.01)

(52) U.S. Cl. ..... 307/66; 307/86; 307/154

(58) Field of Classification Search ..... 320/138; 307/85, 66, 86, 154; 327/408, 19; 713/300; 323/268, 272, 299

See application file for complete search history.

(56) References Cited

U.S. PATENT DOCUMENTS

| | | | | |
|---|---|---|---|---|
| 5,905,365 | A | 5/1999 | Yeh | |
| 6,016,019 | A | 1/2000 | Wojewoda | |
| 6,603,365 | B1 | 8/2003 | Dotzler et al. | |
| 6,892,147 | B2 * | 5/2005 | Bui et al. | 702/63 |
| 2006/0082351 | A1 * | 4/2006 | Martins et al. | 323/268 |

* cited by examiner

*Primary Examiner*—Albert W Paladini
*Assistant Examiner*—Daniel Cavallari
(74) *Attorney, Agent, or Firm*—Thomas, Kayden, Horstemeyer & Risley

(57) ABSTRACT

A power supply. The power supply provides power to a real-time clock generator when system power is not available and comprises first and second regulators, an energy storage device, and a switch. The first regulator receives a system power and generates a first regulated voltage when the system power is available. The energy storage device is coupled to a node. The second regulator comprises an input coupled to the node and provides a second regulated voltage to a real-time clock generator. The switch is coupled between the first regulator and the node. The switch is turned on when the system power is available and turned off when the system power is not available.

26 Claims, 5 Drawing Sheets

POWER SUPPLY FOR REAL-TIME CLOCK GENERATION

This application claims the benefit of U.S. Provisional Application No. 60/746,175, filed on May 2, 2006.

BACKGROUND OF THE INVENTION

1. Field of the Invention

The invention relates to power supply and, in particular, to power supply for real-time clock generation.

2. Description of the Related Art

Most modern electronic systems are provided with real-time clocks that keep track of time even when an electronic system is turned off. Typically, real-time clocks run on a special battery not connected to a normal power supply.

FIGS. 1A and 1B are schematic diagrams of a conventional power supply for real-time clock generation disclosed in U.S. Pat. No. 6,016,019. In FIG. 1A, there are two power sources, a system power $V_{SYS}$ and a battery power $V_{BATT}$, for real-time clock generation. A regulator 102 receives the battery power $V_{BATT}$ and generates a reference voltage $V_{REF}$. A power selection circuit PS comprises an amplifier 26, an inverter 28, and transistors 30 and 32. When the system power $V_{SYS}$ exceeds the reference voltage $V_{REF}$, the power selection circuit PS selects $V_{SYS}$ as a power supply $V_{PP}$ for real-time clock (RTC) circuits. When the system power $V_{SYS}$ is lower than the reference voltage $V_{REF}$, the power selection circuit 102 selects $V_{REF}$ as the power supply $V_{PP}$ for real-time clock (RTC) circuits. As a result, power remains to keep time information of a system even when the system power $V_{SYS}$ is lost.

FIG. 2 is a schematic diagram of another conventional power supply for real-time clock generation disclosed in U.S. Pat. No. 5,905,365. Operating principles thereof are similar to U.S. Pat. No. 6,016,019 and only differ in that the power selection circuit in the disclosure of U.S. Pat. No. 5,905,365 is a diode. The voltage supplied to the RTC circuit is lower than a system power VCC or a battery power BATT by voltage drop of the diode. When the system power VCC is lower than the battery power BATT, the diode D1 is reverse-biased and the diode D2 forward-biased. Thus, the battery power BATT supplies power to the RTC circuit RTC when the system power can not supply enough power to the RTC circuit RTC.

In the conventional power supplies for real-time clock generation, voltage of the system power $V_{SYS}$ or VCC is typically higher or even the highest in the system. In advanced semiconductor process technology, RTC circuits, however, are typically implemented with core devices having lower voltage endurance. Therefore, there is a need to have a new power supply which can provide sufficient power to an RTC circuit without exceeding the low voltage endurance.

BRIEF SUMMARY OF THE INVENTION

An embodiment of a power supply provides power to a real-time clock generator when a system power is not available and comprises first and second regulators, an energy storage device, and a switch. The first regulator receives a system power and generates a first regulated voltage when the system power is available. The energy storage device is coupled to a node. The second regulator comprises an input coupled to the node and provides a second regulated voltage to a real-time clock generator. The switch is coupled between the first regulator and the node. The switch is turned on when the system power is available and turned off when the system power is not available.

Another embodiment of a power supply provides power to a real-time clock generator when system power is not available and comprises an energy storage device, a regulator, and a switch. The energy storage device is coupled to a node. The regulator comprises an input coupled to the node and provides a regulated voltage to a real-time clock generator. The switch is coupled between the system power and the node. The switch is turned on when the system power is available and is turned off when the system power is not available.

The invention provides a power supply for real-time clock generation. In the power supply of the invention, a rechargeable battery is recharged by system power and used as a redundant power supply when the system power is not available. In addition, the power supply of the invention sustains longer when the system power is not available and the improvement becomes more significant in advanced semiconductor process technologies.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

In the disclosure of the invention, a cellular phone is used as an example of an electronic system having an RTC generator. Voltage of system power, i.e. battery power, in the cellular phone typically ranges from 3.3V to 4.2V. Operating voltage of the RTC generator lowers in advanced semiconductor process technologies, typically 1.2V in state of the art technology. As a result, voltage of the system power is much higher than voltage limits of devices in the RTC generator and a voltage regulator is thus required to down-convert the system power to the operating voltage of the RTC generator.

Figure 1A:
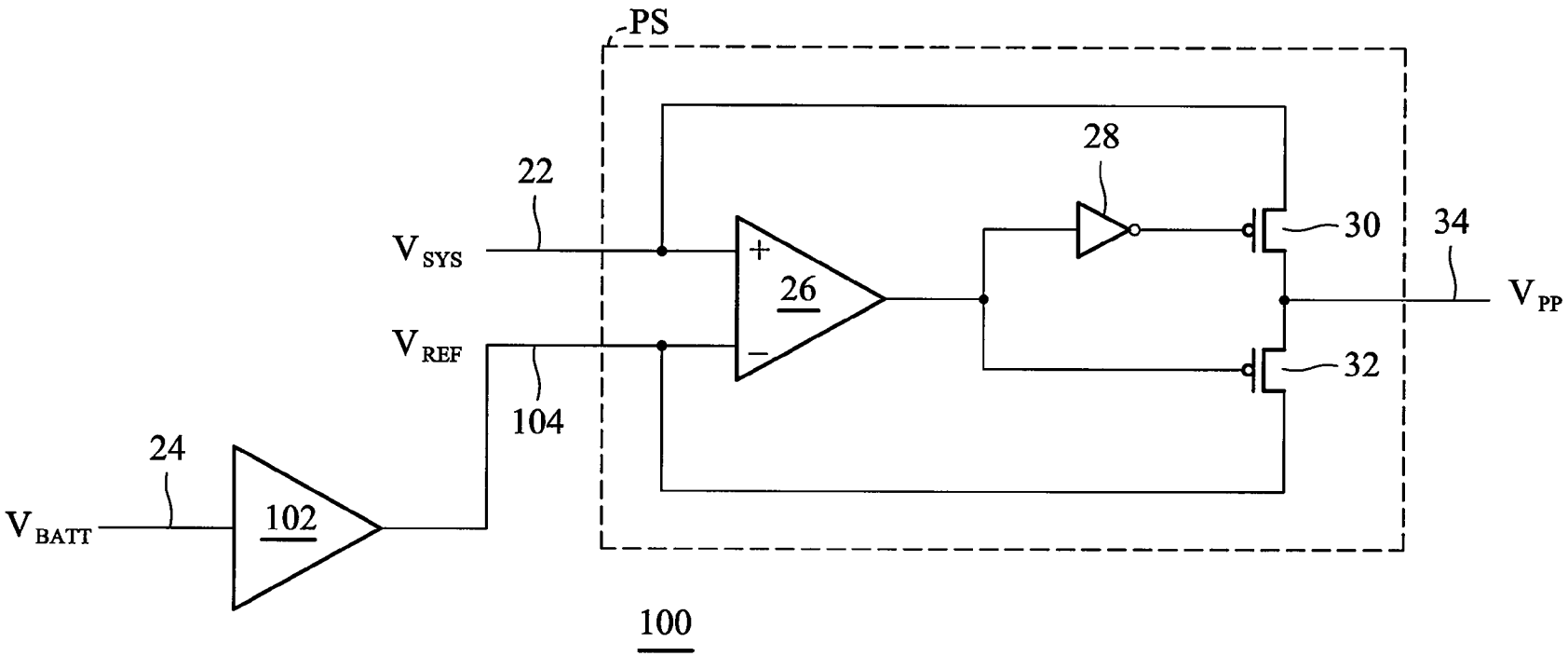
FIG. 1A ( RELATED ART )
FIGS. 1A and 1B are schematic diagrams of a conventional power supply for real-time clock generation as disclosed in U.S. Pat. No. 6,016,019.
Figure 1B:
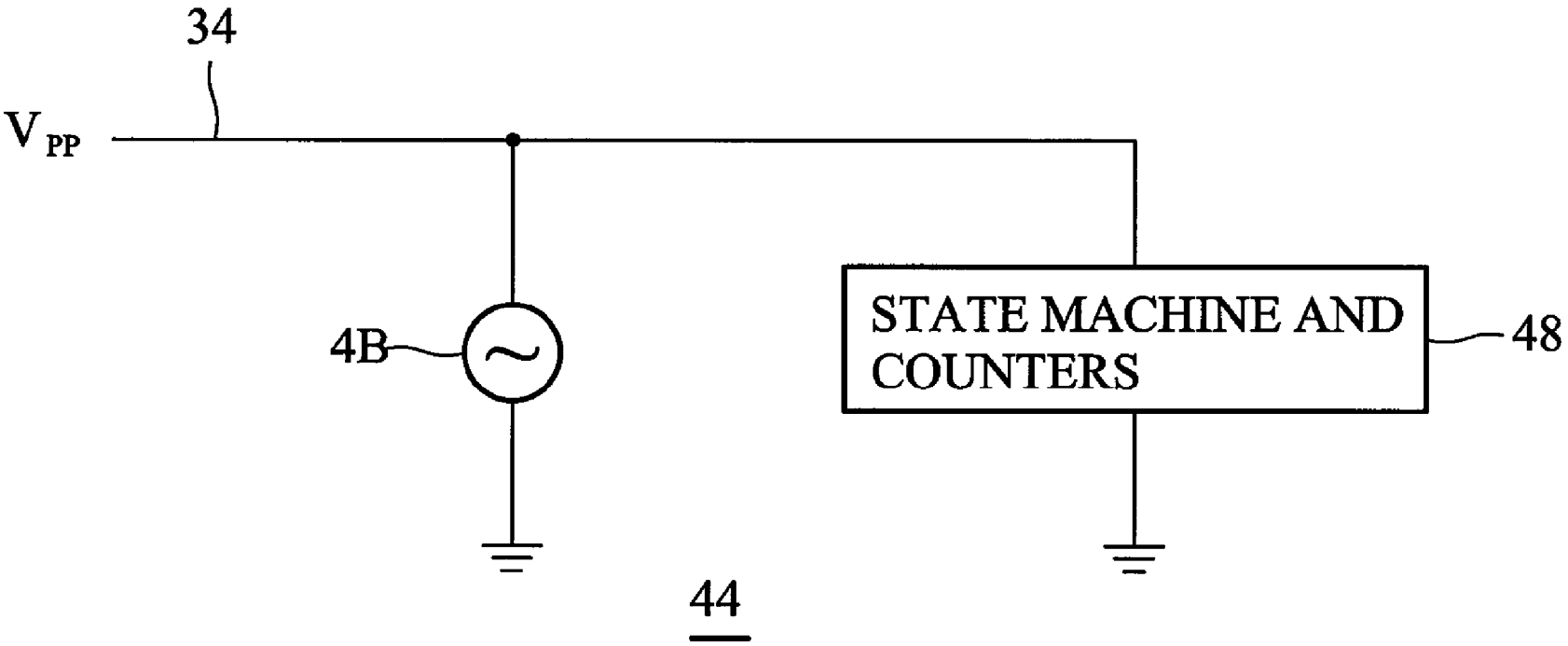
FIG. 1B ( RELATED ART )
Figure 2:
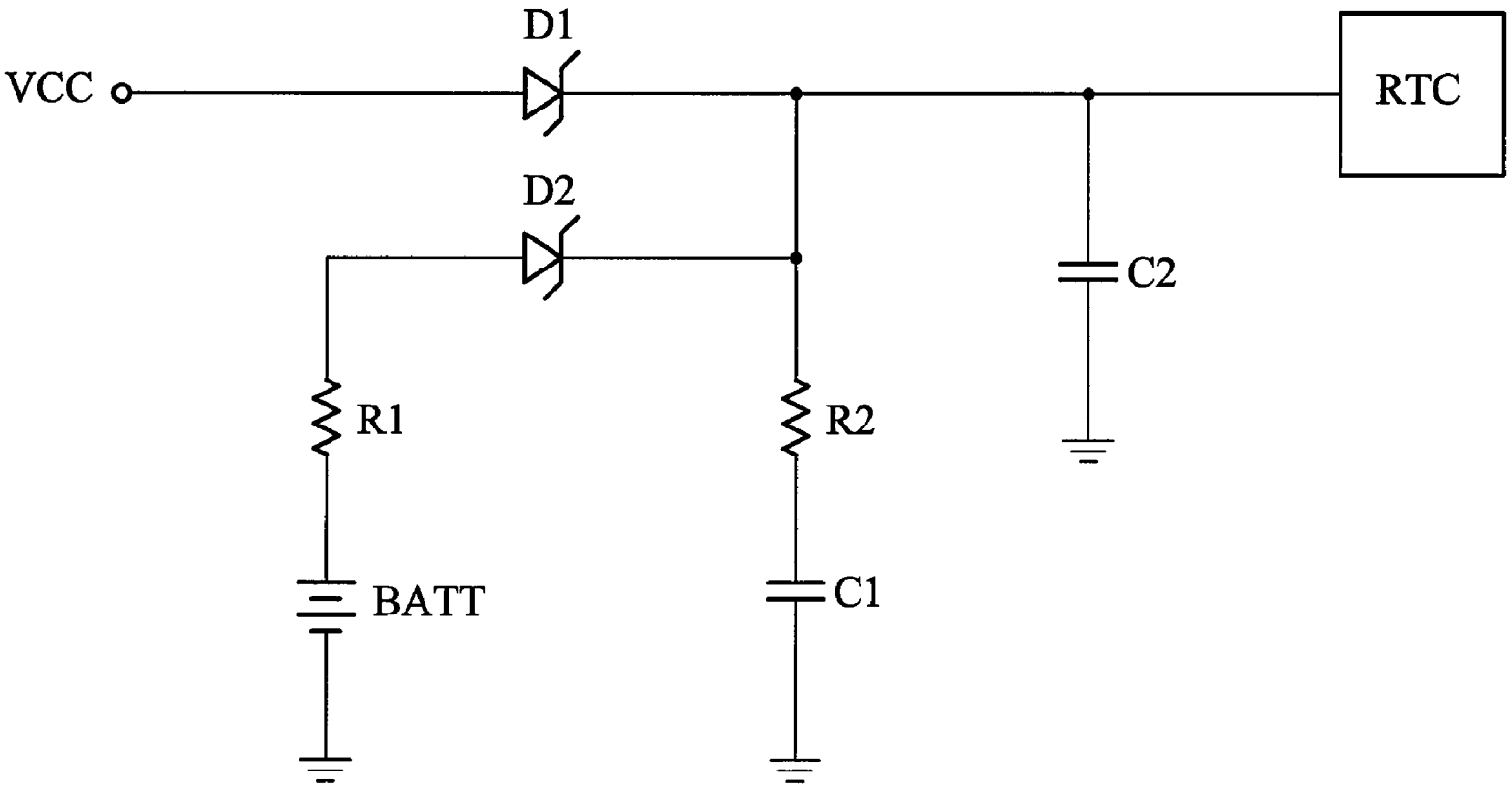
FIG. 2 ( RELATED ART )
FIG. 2 is a schematic diagram of another conventional power supply for real-time clock generation as disclosed in U.S. Pat. No. 5,905,365.
Figure 3:
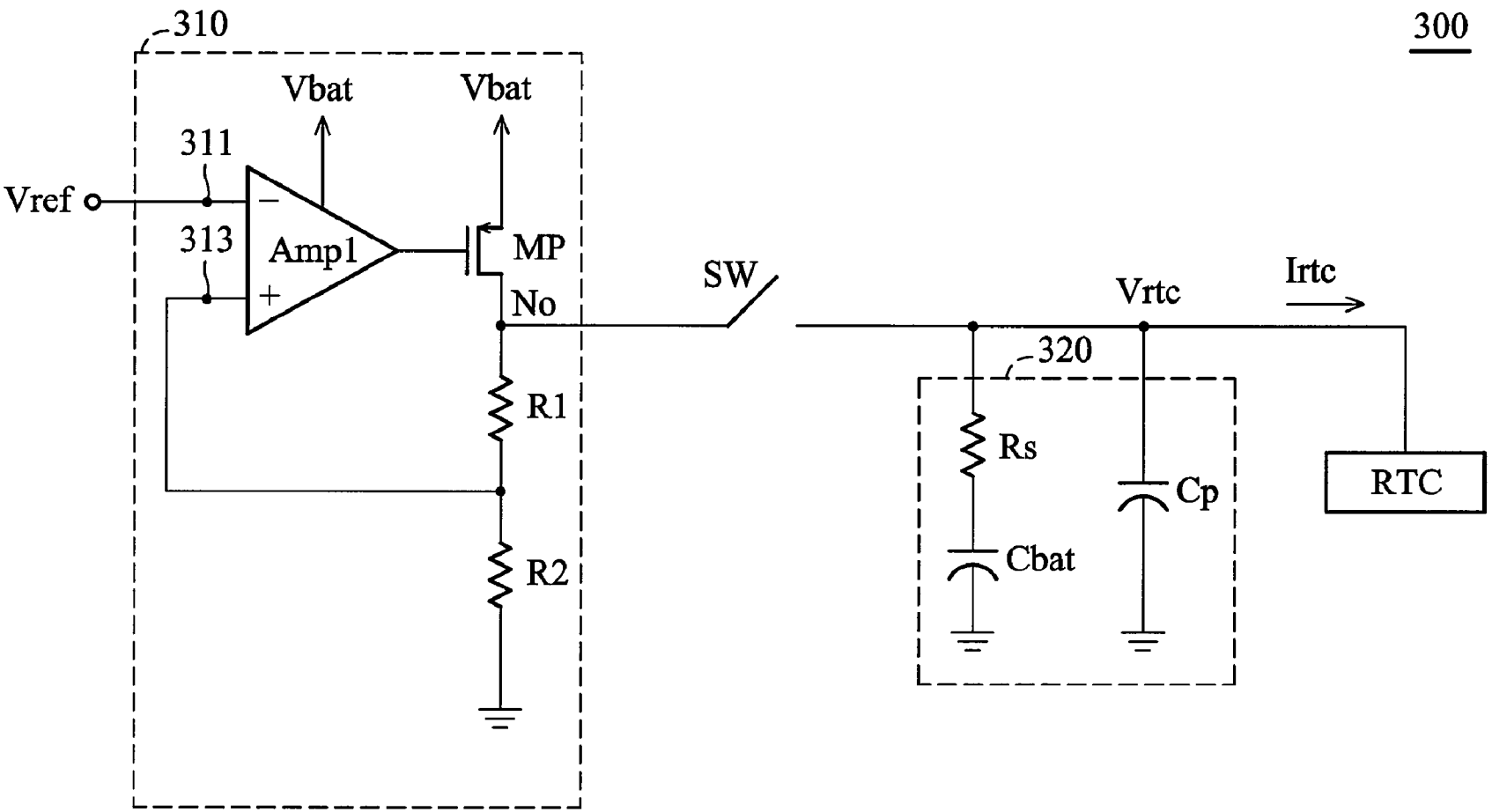
FIG. 3 is a circuit diagram of a power supply in which a low drop-out (LDO) regulator generates an operating voltage of an RTC generator.

FIG. 3 is a circuit diagram of a power supply in which a low drop-out (LDO) regulator generates an operating voltage Vrtc of a RTC generator RTC. The power supply 300 comprises a linear regulator 310, a switch SW, and an energy storage device 320. The linear regulator 310 comprises an amplifier Amp1, a transistor MP, and resistors R1 and R2. An inverting input terminal 311 of the amplifier Amp1 receives a reference voltage Vref and the amplifier Amp1 is powered by a battery power Vbat. The PMOS transistor MP is controlled by an output terminal of the amplifier Amp1. A source of the PMOS transistor MP is connected to the battery power Vbat and a drain thereof connected to an output node No of the linear regulator 310. One end of the resistor R1 is connected to the output node No of the linear regulator 310 and the other end thereof is connected to a non-inverting input terminal 313 of the amplifier Amp1. The resistor R2 is coupled between the other end of the resistor R1 and ground. The energy storage device 320 and the RTC generator RTC are coupled to the output node No of the linear regulator 310 via the switch SW.

The linear regulator 310 converts the battery power Vbat to the operating voltage Vrtc of the RTC generator RTC and supplies electrical energy to the energy storage device 320 when battery power Vbat is available. The energy storage device 320 includes $C_{bat}$, which is a large capacitor or a small rechargeable battery. When battery power is interrupted, the linear regulator 310 cannot work and supply power to the RTC generator RTC. Meanwhile, the energy storage device 320 keeps supplying power to the RTC generator RTC until the operating voltage Vrtc is lower than the lower limit thereof.

When the battery is removed from the cellular phone, power of the RTC generator RTC is supplied by the energy storage device 320. The voltage Vrtc decreases when a current Irtc supplies to the RTC generator RTC. After a time period T, Vrtc will reach Vrtc_min, which is a minimum requirement for the RTC generator RTC to operate. The time period T can be calculated by T=(Vrtc−Vrtc_min)×Cbat/Irtc, wherein Cbat is capacitance of the energy storage device 320, and Irtc is a quiescent current of the RTC generator RTC. To increase the time period T, Vrtc−Vrtc_min or Cbat needs to be increased or Irtc needs to be reduced. However, in advanced semiconductor process technologies, Vrtc−Vrtc_min becomes smaller and it is difficult to reduce the quiescent current Irtc of the RTC generator RTC. Increase of the capacitance Cbat of the energy storage device 320 will increase chip area and cost.

Figure 4:
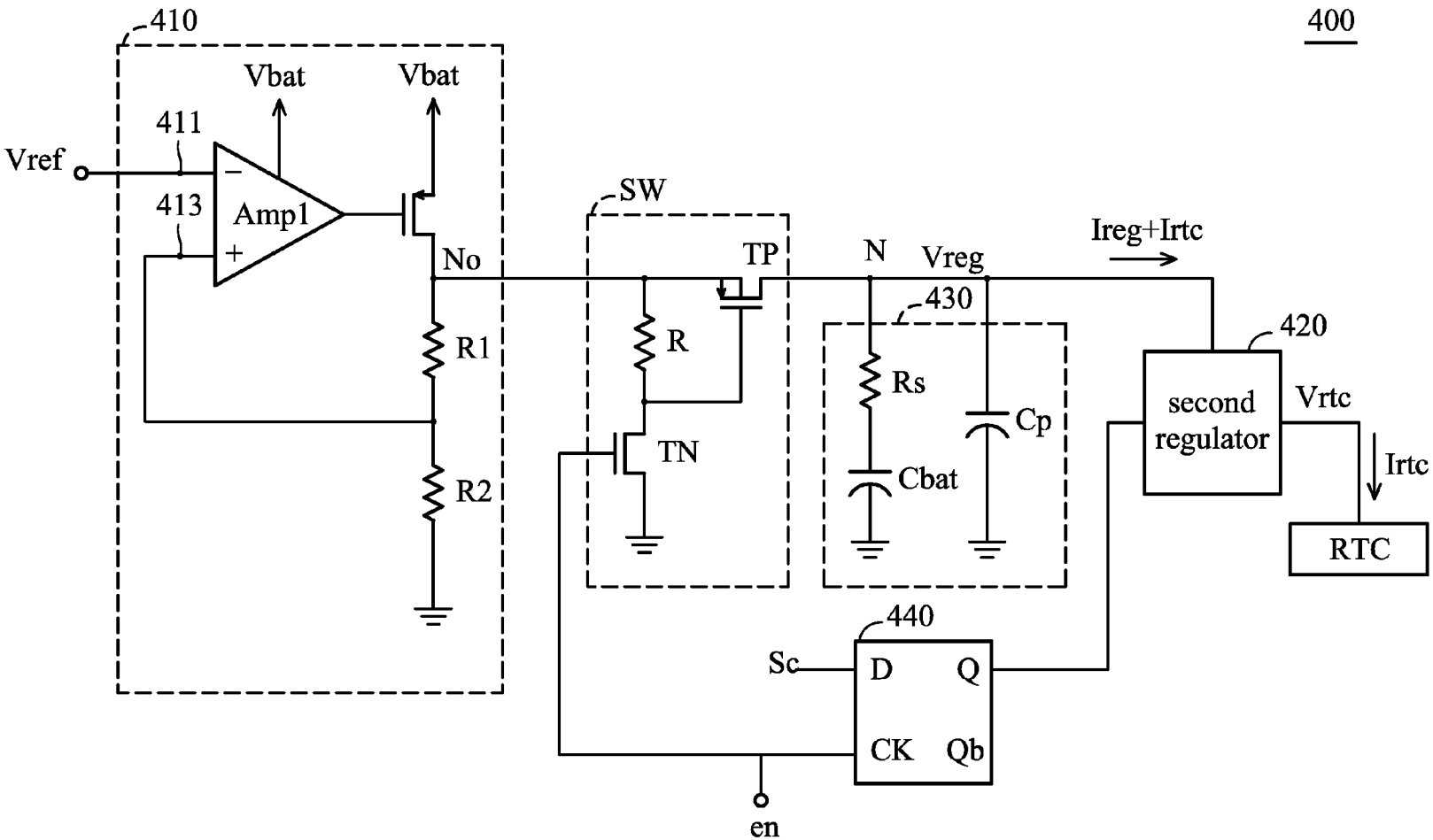
FIG. 4 is a circuit diagram of a power supply for real-time clock generation according to an embodiment of the invention.

FIG. 4 is a circuit diagram of a power supply for real-time clock generation according to an embodiment of the invention. The power supply comprises a first regulator 410, a second regulator 420, an energy storage device 430, and a switch SW. The first regulator 410 receives a reference voltage Vref and is powered by a system power Vbat. The first regulator 410 can be a low drop out (LDO) regulator. Preferably, the first regulator 410 comprises an amplifier Amp1, a transistor MP, and resistors R1 and R2. An inverting input terminal 411 of the amplifier Amp1 receives the reference voltage Vref and the amplifier Amp1 is powered by the battery power Vbat. The PMOS transistor MP is controlled by an output terminal of the amplifier Amp1. A source of the PMOS transistor MP is connected to the battery power Vbat and a drain thereof connected to an output node No of the linear regulator 410. One end of the resistor R1 is connected to the output node No of the linear regulator 410 and the other end thereof is connected to a non-inverting input terminal 413 of the amplifier Amp1. The resistor R2 is coupled between the other end of the resistor R1 and ground. The energy storage device 430 is coupled to a node N. The energy storage device 430 includes Cbat, which can be a capacitor or a rechargeable battery. Preferably, the energy storage device 430 comprises a resistor Rs and a first capacitor Cbat connected in series between the node N and ground and a second capacitor Cp also connected between the node and ground, as shown in FIG. 4. In this example, the second capacitor Cp has very small capacitance compared with Cbat. The second regulator 420 has an input coupled to the node N and an output providing power to the RTC generator RTC. The switch SW is coupled between the first regulator 410 and the node N.

When voltage of the battery power Vbat exceeds a predetermined value, the switch SW is turned on. Meanwhile, the first regulator 410 down-converts the battery power Vbat to a first regulated voltage Vreg. Since the switch SW is turned on, the first regulated voltage Vreg is transferred to the node N. The second regulator 420 receives the first regulated voltage Vreg and generates the second regulated voltage Vrtc. When voltage of the battery power Vbat is lower than the predetermined value, the switch SW is turned off. Since the switch SW is turned off, energy stored in the energy storage device 430 does not flow back to the first regulator 410. The energy storage device 430 provides energy stored therein to the second regulator 420 and the second regulator 420 keeps providing the second regulated voltage Vrtc to the RTC generator RTC until the energy stored in the energy storage device 430 is insufficient.

When the battery is removed from the cellular phone, power of the RTC generator RTC is supplied by the energy storage device 430. The voltage Vreg decreases when a current (Irtc+Ireg) supplies to the second regulator 420. After a time period T', Vrtc will reach Vrtc_min, which is a minimum requirement for the RTC generator RTC to operate. The time period T' can be calculated by T'=(Vreg−Vrtc_min−Vdrop_out)×Cbat/(Irtc+Ireg), wherein Vdrop_out is a voltage drop across the second regulator 420, Cbat is capacitance of the energy storage device 430, Irtc is a quiescent current of the RTC generator RTC, and Ireg is a quiescent current of the second regulator 420. Since the first regulated voltage Vreg is not directly provided to the RTC regulator RTC, the first regulated voltage Vreg is much higher than the normal operating voltage, i.e. the second regulated voltage Vrtc herein, of the RTC regulator RTC and even up to the voltage level of the battery power Vbat. Thus, (Vreg−Vrtc_min−Vdrop_out) in the power supply of the invention is much higher than (Vrtc−Vrtc_min) in the previously disclosed power supply. As a result, if the quiescent current Ireg of the second regulator 420 is small enough, the power supply can provide power to the RTC generator with longer time.

In FIG. 4, the switch SW comprises a PMOS transistor TP, a resistor R, and a NMOS transistor TN. A gate and a source of the PMOS transistor TP are coupled to each other via the resistor R. A drain of the PMOS transistor TP is coupled to the node N. A drain and a source of the NMOS transistor TN are respectively connected to the gate of the PMOS transistor TP and ground. A gate of the NMOS transistor TN is controlled by an enable signal en from the system. When the enable signal en is at a logic state "high", the NMOS transistor TN is turned on and the gate of the PMOS transistor TP pulled low. As a result, the PMOS transistor TP is turned on and the first regulated voltage Vreg is transferred to the node N. When the enable signal en is at a logic state "low", the NMOS transistor TN is turned off and voltage levels of the gate and the source of the PMOS transistor TP are thus almost the same. As a result, the PMOS transistor TP is turned off and energy stored in the energy storage device 430 cannot flow back to the first regulator 410. The energy storage device 430 provides power to the RTC generator RTC for real-time clock generation.

The power supply for real-time clock generation can further comprise a control bit latch 440. The control bit latch 440 is coupled to the second regulator 420. A control input CK and a data input D of the control bit latch 440 respectively receive the enable signal en and a control signal Sc from the system. When voltage of the battery power Vbat exceeds a predetermined value, the enable signal en is at a logic state "high" and the control bit latch 440 receives and directly outputs the control signal Sc to the second regulator 420. The second regulator 420 is reconfigured according to the control signal Sc and the second regulated voltage Vrtc is thus adjustable. When voltage of the battery power Vbat is lower than the predetermined value, the enable signal en switches to a logic state "low" and the control bit latch 440 latches the control signal Sc. As a result, the state of the control bit is retained at the data output Q, and the RTC generator continues to function normally even when the system power is lost. In this embodiment, the second regulated voltage Vrtc is selected among different voltage levels based on the control bit.

While the invention has been described by way of example and in terms of preferred embodiment, it is to be understood that the invention is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A power supply comprising:

a first regulator, receiving a system power and generating a first regulated voltage when the system power is available;

an energy storage device coupled to a node;

a second regulator comprising an input coupled to the node, the second regulator providing a second regulated voltage to a real-time clock generator; and a switch coupled between the first regulator and the node, the switch being turned on when the system power is available and being turned off when the system power is not available.

2. The power supply as claimed in claim 1, further comprising a control bit latch coupled to the second regulator and latching control signals from a system when the system power is not available.

3. The power supply as claimed in claim 2, wherein the control bit latch is controlled by the system and latches the control signals when voltage of the system power is lower than a predetermined voltage.

4. The power supply as claimed in claim 1, wherein the energy storage device is a capacitor or a rechargeable battery.

5. The power supply as claimed in claim 1, wherein the energy storage device comprises a resistor and a first capacitor connected in series between the node and ground and a second capacitor connected between the node and ground.

6. The power supply as claimed in claim 1, wherein the switch is controlled by a system and turned off when voltage of the system power is lower than a predetermined voltage.

7. The power supply as claimed in claim 6, wherein the switch comprises a PMOS transistor having a drain coupled to the node and a gate and a source coupled to each other via a resistor and an NMOS transistor having a drain connected to the gate of the PMOS transistor, a source connected to ground and a gate controlled by the system.

8. The power supply as claimed in claim 1, wherein the first regulator is a low drop out (LDO) regulator.

9. The power supply as claimed in claim 8, wherein the low drop out (LDO) regulator comprises an amplifier powered by system power, receiving a reference voltage at an inverting input terminal thereof, a PMOS transistor having a source coupled to the system power, a gate coupled to an output terminal of the amplifier and a drain coupled to the switch, a first resistor having one end coupled to the drain of the PMOS transistor and the other end coupled to a non-inverting input terminal of the amplifier, and a second resistor having one end coupled to the other end of the first resistor and the other end coupled to ground.

10. The power supply as claimed in claim 1, wherein the system power is a battery.

11. A power supply comprising:

an energy storage device coupled to a node;

a regulator comprising an input coupled to the node, the regulator providing a regulated voltage to a real-time clock generator; and a switch coupled between a system power and the node, the switch being turned on when the system power is available and being turned off when the system power is not available.

12. The power supply as claimed in claim 11, further comprising a control bit latch coupled to the regulator and latching control signals from a system when the system power is not available.

13. The power supply as claimed in claim 12, the control bit latch is controlled by the system and latches control signals when voltage of the system power is lower than a predetermined voltage.

14. The power supply as claimed in claim 11, wherein the energy storage device is a capacitor or a rechargeable battery.

15. The power supply as claimed in claim 11, wherein the energy storage device comprises a resistor and a first capacitor connected in series between the node and ground and a second capacitor connected between the node and ground.

16. The power supply as claimed in claim 11, wherein the switch is controlled by a system and turned off when voltage of the system power is lower than a predetermined voltage.

17. The power supply as claimed in claim 16, wherein the switch comprises a PMOS transistor having a drain coupled to the node and a gate and a source coupled to each other via a resistor and an NMOS transistor having a drain connected to the gate of the PMOS transistor, a source connected to ground and a gate controlled by the system.

18. The power supply as claimed in claim 11, wherein the system power is a battery.

19. A power supply comprising:

an energy storage device coupled to a node;

a regulator comprising an input coupled to the node, the regulator providing a regulated voltage to a real-time clock generator; and a switch coupled between a system power and the node and disposed outside of the regulator, the switch being turned on when the system power is available and being turned off when the system power is not available.

20. The power supply as claimed in claim 19, further comprising a control bit latch coupled to the regulator and latching control signals from a system when the system power is not available.

21. The power supply as claimed in claim 20, the control bit latch is controlled by the system and latches control signals when voltage of the system power is lower than a predetermined voltage.

22. The power supply as claimed in claim 19, wherein the energy storage device is a capacitor or a rechargeable battery.

23. The power supply as claimed in claim 19, wherein the energy storage device comprises a resistor and a first capacitor connected in series between the node and ground and a second capacitor connected between the node and ground.

24. The power supply as claimed in claim 19, wherein the switch is controlled by a system and turned off when voltage of the system power is lower than a predetermined voltage.

25. The power supply as claimed in claim 24, wherein the switch comprises a PMOS transistor having a drain coupled to the node and a gate and a source coupled to each other via a resistor and an NMOS transistor having a drain connected to the gate of the PMOS transistor, a source connected to ground and a gate controlled by the system.

26. The power supply as claimed in claim 19, wherein the system power is a battery.

* * * * *